US005234709A

United States Patent [19]

Saita et al.

[11] Patent Number: 5,234,709

[45] Date of Patent: Aug. 10, 1993

[54] PROCESS FOR PRODUCING THERMAL HEAD

[75] Inventors: Yoshiaki Saita; Seiji Kuwahara; Yoshinori Sato, all of Tokyo, Japan

[73] Assignee: Seiko Instruments Inc., Japan

[21] Appl. No.: 573,533

[22] Filed: Aug. 27, 1990

[51] Int. Cl.[5] ..... C23C 26/00

[52] U.S. Cl. ..... 427/58; 427/126.2; 346/76 PH

[58] Field of Search ..... 427/58, 126.2; 346/76 PH

[56] References Cited

U.S. PATENT DOCUMENTS

| | | | |
|---|---|---|---|
| 3,757,350 | 9/1973 | Fliegner | 346/76 PH |
| 4,835,550 | 5/1989 | Sato | 346/76 PH |
| 4,973,986 | 11/1990 | Narita | 346/76 PH |

FOREIGN PATENT DOCUMENTS

| | | | |
|---|---|---|---|
| 0229953 | 7/1987 | European Pat. Off. . | |
| 37178 | 4/1981 | Japan | 346/76 PH |
| 184856 | 9/1985 | Japan | 346/76 PH |
| 139453 | 6/1986 | Japan | 346/76 PH |
| 2151989 | 7/1985 | United Kingdom | 346/76 PH |

OTHER PUBLICATIONS

Patent Abstracts of Japan, vol. 008, No. 224 (M—331) Oct. 13, 1984.

Patent Abtracts of Japan, vol. 009, No. 107 (M-378) May 11, 1985.

Patent Abstracts of Japan, vol. 012, No. 267 (M-722) Jul. 26, 1988.

*Primary Examiner*—Shrive Beck
*Assistant Examiner*—Vi Duong Dang
*Attorney, Agent, or Firm*—Bruce L. Adams; Van C. Wilks

[57] ABSTRACT

A method of simultaneously producing a plurality of thermal heads having a ridge-shaped glaze structure uses first and second glass pastes, the second glass paste having a higher softening temperature than the first glass paste. The first glass paste is printed on a substrate in a pattern having a plurality of adjacent slit-shaped openings in parallel. Next, the second glass paste is printed in a pattern having independent bands which cover the openings. The first and second glass pastes are melted and hardened simultaneously by heat treatment so as to form the ridge-shaped glaze structure. A plurality of isolated individual resistors are formed linearly along the crest of the ridge-shaped glaze structure, and a plurality of isolated individual traces are formed which connect at one end to each of the resistors. Lastly, the substrate is divided along separation lines into a plurality of thermal heads having a ridge-shaped glaze structure.

13 Claims, 6 Drawing Sheets

PROCESS FOR PRODUCING THERMAL HEAD

BACKGROUND OF THE INVENTION

1. Field of the Invention

This invention is concerned with a production of at least one thermal head having ridge-shaped glaze structure. More specifically, the invention is concerned with the production of a thermal head substrate that divides into a plurality of thermal heads after forming a plurality of ridge-shaped glaze layers adjacent to and in parallel with one another over a principal surface of the substrate.

2. Description of the Prior Art

Conventionally a thermal head is produced as follows.

First, a glass paste is printed in a pattern having adjacent bands in parallel over the principal surface of a substrate by a screen printing method.

Next, it is treated by heating to form ridge-shaped glaze layer having an arcuate section.

Then, a plurality of isolated individual resistors are formed by patterning after electrically resistive material is deposited in the vicinity of the ridge-shaped glaze layer.

Finally, a plurality of isolated individual traces are formed by patterning after electrically conductive material is deposited on the substrate. Each of traces connects at one end to each of the resistors and applies heat to the resisters.

Conventionally ceramics are utilized as the substrate. The substrate portions formed without the glaze layer have porous surfaces with a roughness of about 1 μm so that they are liable to cause defects such as shorted or broken traces. Due to a slight difference in the wettability between the principal surface of the substrate and the glass paste, moreover, the width of the glaze layers may vary or their surfaces may undulate, thus creating the potential of another defect in that the adjacent glaze layer may merge into each other.

SUMMARY OF THE INVENTION

An object of the present invention is to provide a process for efficiently producing a thermal head which has ridge-shaped glaze structures including a plane glaze layer and a ridge-shaped glaze layer.

Another object of the present invention is to provide a process for efficiently producing a thermal head which has a ridge-shaped glaze structure including a plane glaze layer and ridge-shaped glaze layers.

A further object of the present invention is to provide a process for efficiently producing a plurality of thermal heads having a ridge-shaped glaze structure from a substrate.

To realize above objects, the present invention produces thermal heads according to following steps.

A first glass paste is printed on the principal surface of the substrate in a pattern having a plurality of adjacent slit-shaped openings in parallel by a screen printing method.

Next, a second glass paste is printed in a pattern having independent bands which cover as cover the slit-shaped openings.

Next, the first and second glass pastes are melted and hardened simultaneously so that the substrate obtains a ridge-shaped glaze structure which consists of a plane glaze layer and ridge-shaped glaze layer.

Next, a plurality of isolated individual resistors is formed by patterning after electrically resistive material is deposited in the vicinity of the ridge-shaped glaze layer. Further, a plurality of isolated individual traces are formed by patterning after electrically conductive material is deposited on the substrate.

In this case, the second glass paste has a higher softening temperature than the first glass paste so that it can obtain the ridge-shaped glaze structure. Newly formed slit-shaped spacing between the adjacent openings protect adjacent ridge-shaped glaze layers from merging. Since the desired portions of the principal surface of the substrate can be coated with the glaze layer, the substrate can have a smooth surface, if it is made of ceramics, to raise the patterning yield and can function as an insulating coating if it is made of metal. Further, the first and second glass pastes can be printed in the matrix of the aforementioned patterns on one large substrate so as to produce a plurality of thermal heads from one substrate.

DETAILED DESCRIPTION OF THE PREFERRED EMBODIMENT

Hereinafter and the present invention will be explained in accordance with the detail with reference to some embodiments thereof shown in the accompanying drawings.

Figure 1:
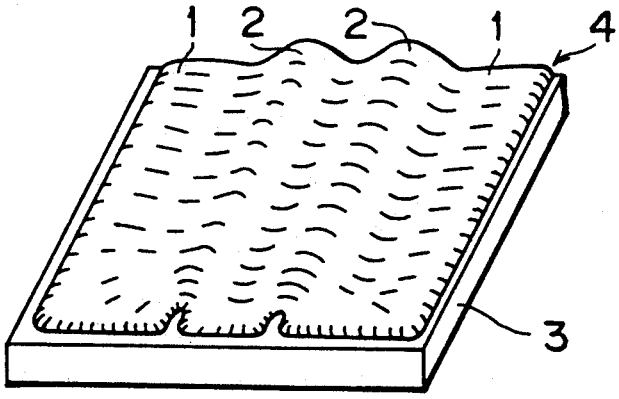
FIGS. 1(A) and 1(B) are a perspective view and a sectional view of a glazed substrate formed in accordance with the present invention.
Figure 1:
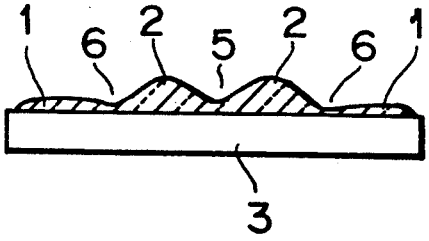

FIGS. 1(A), 1(B) are a perspective view and a sectional view of a glazed substrate formed in process of the present invention.

The glazed substrate 4 includes a rectangular substrate 3 and a ridge-shaped glaze layer. The substrate 3 is a flat plate and constructed of material, such as ceramics, such that it acts as an insulator to electrical current and a heat sink for the thermal energy created by the operation of the print head. Over a principal surface of the substrate 3, there is formed the ridge-shaped glaze layer having a first glaze layer 1 and a strip of a second glaze layer 2 contacting with the first glaze layer 1. The principal surface of the substrate 3 is mostly coated with the first and second glaze layers 1, 2 so that the glazed substrate 4 has a smooth and continuous surface made of amorphous glaze.

The step of forming the glazed substrate 4 will be described in the following.

Figure 2:
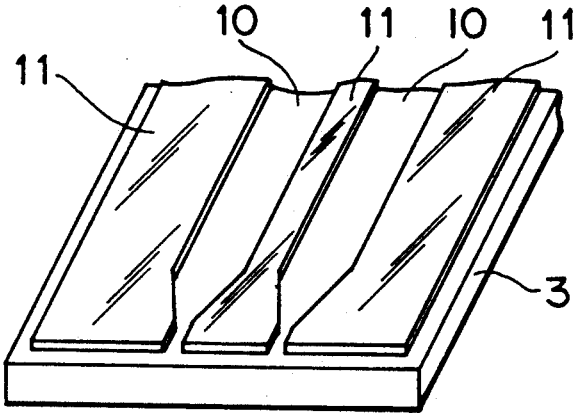
FIGS. 2(A), 3(A) and 2(B), 3(B) are perspective views and sectional views of assistance in explaining the process for producing the glazed substrate shown in FIGS. 1(A) and 1(B)
Figure 2:
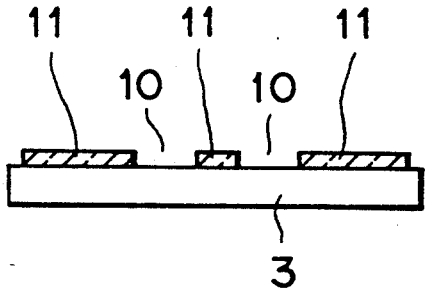
Figure 3:
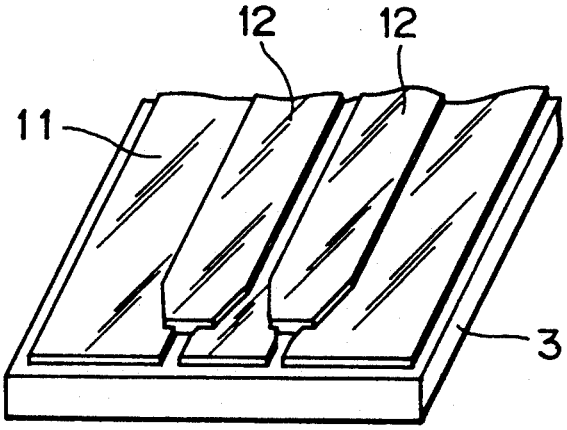
Figure 3:
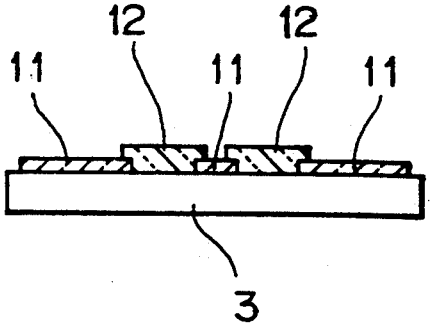

A first glass paste 11 is formed by a screen printing method in a pattern having a plurality of adjacent slit-shaped openings 10 in parallel over the principal surface of the substrate 3, as shown in FIGS. 2(A) and 2(B). Next, second glass pastes 12 are formed by the screen printing method in a pattern having such independent bands as cover the slit-shaped openings 10, as shown in FIGS. 3(A) and 3(B). The second glass paste 12 has a higher softening temperature than the first glass paste 11. The width of the band of the second glass paste 12 is slightly larger than that of the opening 10 of the first glass paste 11. The orders of printing the first and second glass pastes may be varied. After these printing steps, the first and second glass pastes 11, 12 are melted and hardened by heat treatment at a temperature higher than the softening temperature of the second glass paste 12 so that the glazed substrate 4 having the ridge-shaped glaze layer is obtained, as shown in FIGS. 1(A) and 1(B). It is desired that the softening temperature difference between the first and second glass pastes 11, 12 is 50° C. to 200° C. and the temperature for the heat treatment is higher by 200° C. to 400° C. than the softening temperature of the second glass paste 12.

Next, the shape of the glazed substrate 4 will be explained in the following.

FIGS. 4(A)–4(D) and 4(AA)–4(DD) show the glazed substrate 4 when the gap a between the openings 10 in the printed pattern of the first glass paste 11 and the gap b between the bands of the second glass paste 12 are changed.

Figure 4A:
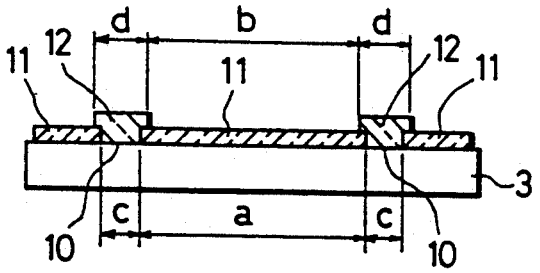
FIGS. 4(A), 4(B), 4(C), 4(D) and 4(AA), 4(BB), 4(CC), 4(DD) are sectional views of assistance in explaining the relation between patterns of the glass pastes and the shape of the glaze layer.
Figure 4:
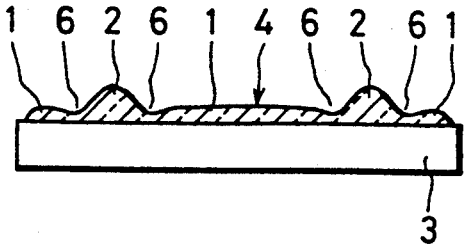
Figure 4B:
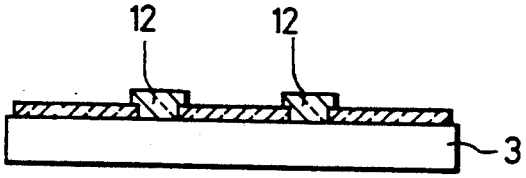
Figure 4:
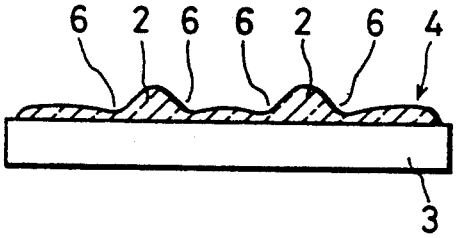
Figure 4C:
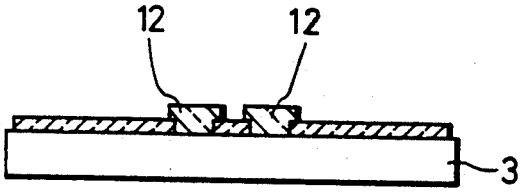
Figure 4:
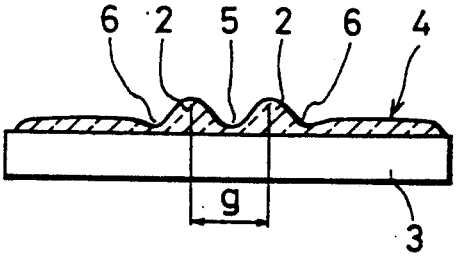
Figure 4D:
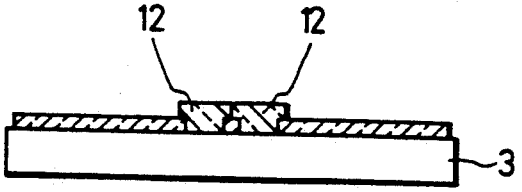
Figure 4:
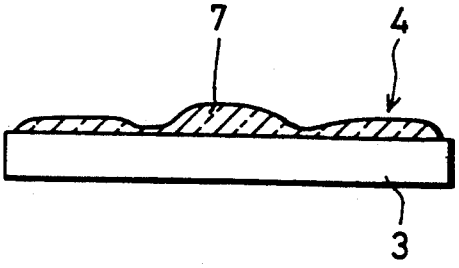

When the gaps a, b are at a relatively larger distance, as shown in FIGS. 4(A) and 4(B), the glazed substrate 4 has the plane first glaze layer 1, the ridge-shaped second glaze layer 2 and small dents 6 which are formed in the rising of the ridge-shaped second glaze layers 2, as shown in FIGS. 4(AA) and 4(BB). As the gaps a, b are made smaller, the adjacent second glaze layers 2 come closer to each other. The dents 6 between the adjacent second glaze layers 2 come to each other until they merge to form one U-shaped valley 5, as shown in FIG. 4(CC). If, however, the gaps a, b are further reduced, as shown in FIG. 4(D), the second glaze layers 2 merge to form generally one ridge 7, as shown in FIG. 4(DD). It is desired that the gaps a, b for forming the glazed substrate 4 shown in FIG. 4(CC) are about 0.4 to 2.0 mm although it depends upon the opening width c, the band-shaped pattern width d of the second glass paste 12 and the kind of the first and second glass paste materials. Further, the gap g between the crests of the ridges of the second glaze layers 2 is about 1.7 to 2.5 mm when the gaps c, d are about 1.5 mm.

The aforementioned values a, b, c, d, g may be suitably selected with the thickness or height of the first and second glaze layers 1, 2 in dependence upon the application of the thermal head according to the present invention.

Figure 5:
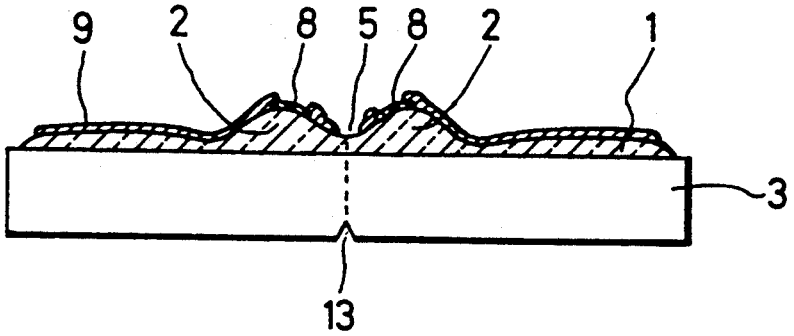
FIG. 5 is a sectional view showing an embodiment of the steps in the process of the present invention after the glaze layers have been formed.

FIG. 5 is a sectional view showing an embodiment of the steps in the process of the present invention after the glaze layers have been formed.

Figure 6:
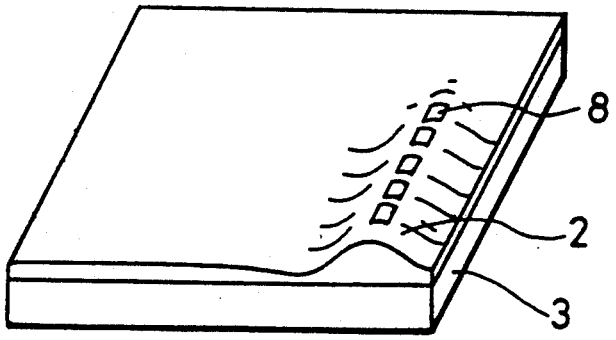
FIG. 6 is a perspective view of the edge-shaped thermal head which is produced by the present inventions.

A plurality of isolated individual resistors 8 are formed by patterning after electrically resistive material is deposited in the vicinity of the crests of the second glaze layers 2. Next, a plurality of isolated individual traces 9 are formed by patterning after electrically conductive material is deposited on the glazed substrate 4. Each of traces 9 connects at one end to each of the resistors 8 and applies electrical power for generating heat to the resistors 8. It is desired that a protective-passivating layer, which operates to protect the various elements deposited on the glazed substrate 4 from chemical or physical abrasion, is deposited over the area of the glazed substrate 4 which covers the surface of the resistors 8 at least. Lastly, the substrate 3 is divided into edge-shaped thermal heads, as shown in FIG. 6, by a snap line 13 formed in the back of the substrate 3.

Figure 7:
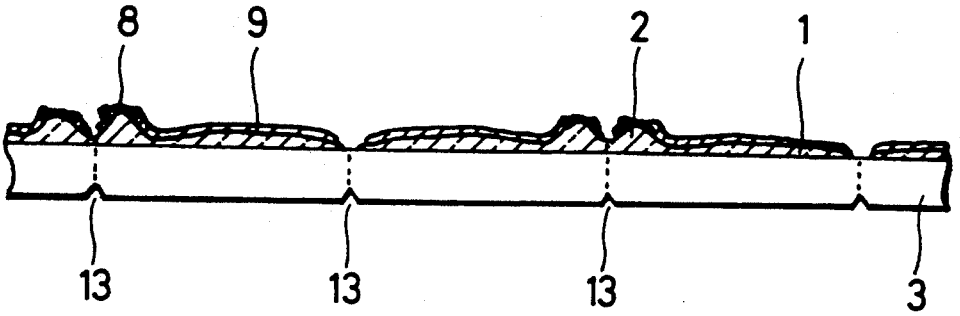
FIG. 7 is a sectional view of an alternate embodiment of the steps in the process of the present invention.

FIG. 7 is a sectional view of an alternate embodiment of the steps in the process of the present invention.

The first glass paste 11 is formed on a large substrate 3 by the screen printing method in a pattern which the pattern shown in FIG. 2(A) is arrayed in matrix. The second glass paste 12 is formed by the screen printing method in the pattern having such independent bands as cover the slit-shaped openings 10. After these Printing steps, the first and second glass pastes 11, 12 are melted and hardened by heat treatment at a temperature higher than the softening temperature of the second glass paste 12. Next, resistors 8 and traces 9 are formed in the same way with the aforementioned embodiment. As a result, the substrate shown in FIG. 7 is obtained. Lastly, the substrate is divided into a plurality of edge-shaped thermal heads by snap lines 13 formed in the back of the substrate 3 in matrix.

Figure 8:
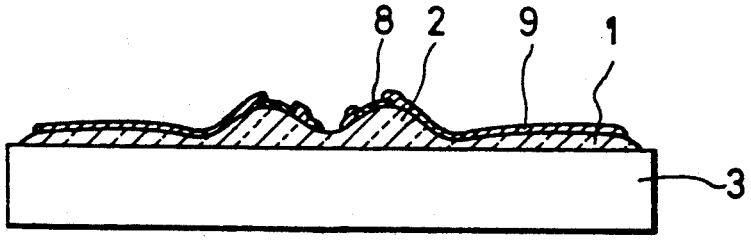
FIG. 8 is a sectional view of the thermal head having two ridge-shaped glaze layers which is produced by the present invention.

Further, the substrate can be divided into a plurality of thermal heads having the structure of two ridge-shaped glaze layers arranged in parallel and adjacent to one another, as shown in FIG. 8, by snap lines 13 formed between the adjacent first glaze layers 1 in the back of the substrate 3. In this case, it is desired that a distance P between the resistors 8 formed on the two ridge-shaped glaze layers is formed as $P=2np$ ($n=1, 2, 3, \ldots$, $p$=a pitch of printing dot). A printing apparatus using this thermal head can drive the resistors 8 alternately so that it can print at high speed.

Figure 9:
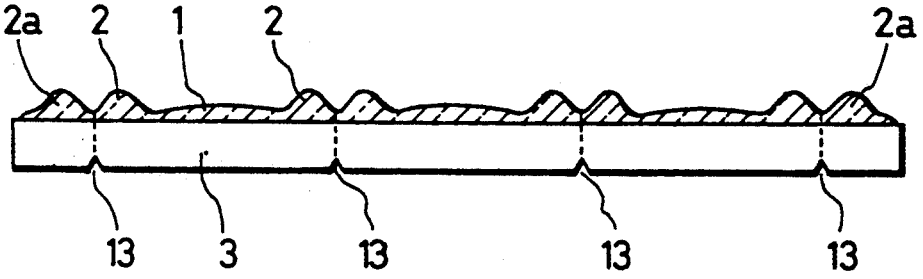
FIG. 9 is a sectional view of an alternate embodiment of the steps in the process of the present invention.
Figure 10:
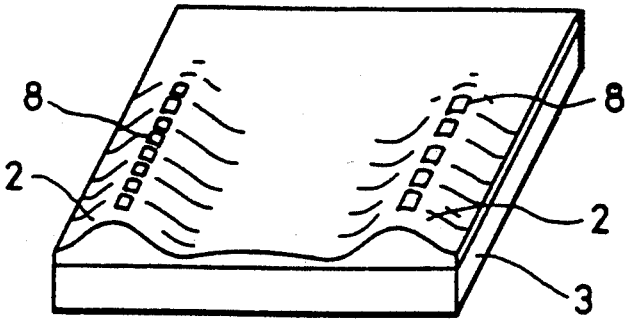
FIG. 10 is a perspective view of the thermal head having two ridge-shaped glaze layers which is produced by the present invention.

FIG. 9 is a sectional view of an alternate embodiment of the steps in the process of the present invention. The substrate 3 is formed with the ridge-shaped glaze layers in the same way with the aforementioned embodiments, as shown in FIG. 9. After resistors 8 and traces 9 are formed on the glaze layer, it is divided into a plurality of thermal heads having two lines of resistors 8, as shown in FIG. 10, by snap liens 13 formed in the back of the substrate 3. In this case, dummy glaze layers 2*a* are formed at the outside of outer second glaze layers 2. In the presence of the dummy glaze layers 2*a*, when the first and second glaze layers 1, 2 are melted by heat treatment, the surface tensions, which are intrinsic in case two or more kinds of glass paste materials are used, are equal except the dummy glaze layers 2*a*, so that the second glaze layers 2 have little variation in their shapes.

FIGS. 11(A)–11(D) are sectional views of an alternate embodiment of the steps in the present invention.

Figure 11A:
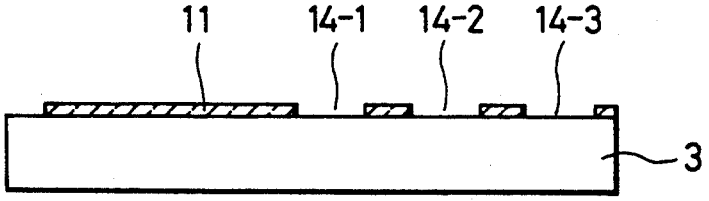
FIGS. 11(A), 11(B), 11(C), 11(D) are sectional views of an alternate embodiment of the steps in the process of the present invention.
Figure 11B:
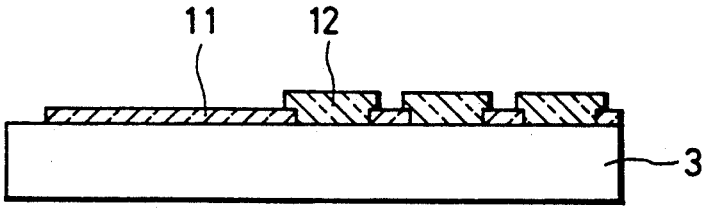
Figure 11C:
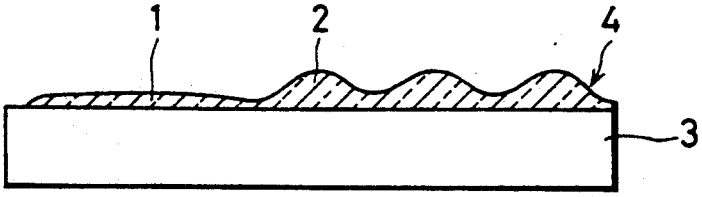
Figure 11D:
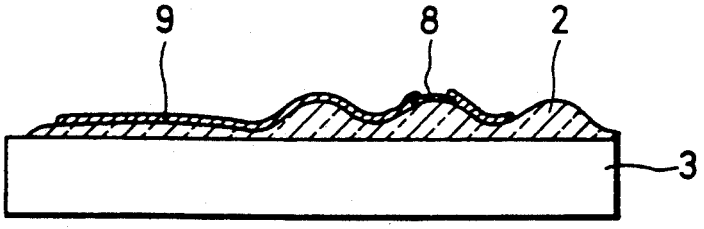

The first glass paste 11 is formed by the screen printing method in a striped pattern having a plurality of adjacent slit-shaped openings 14-1, 14-2, 14-3 in parallel over the principal surface of the substrate 3, as shown in FIG. 11(A). Next, the second glass pastes 12 are formed by the screen printing method in a pattern having such independent bands as cover the openings 14-1, 14-2, 14-3, as shown in FIG. 11(B). After these printing steps, the first and second glass pastes 11, 12 are melted and hardened by heat treatment in the same way with the aforementioned embodiments so that the glazed substrate 4 is obtained, as shown in FIG. 11(C). Further, the resistors 8 and the traces 9 are formed on the glazed substrate 4. Lastly, the substrate 3 is divided into a plurality of thermal heads having three ridge-shaped glaze layers, as shown in FIG. 11(D). This thermal head is utilized in a perfecting printing apparatus by arranging two thermal heads in contact with each other.

FIGS. 12(A)–12(D) are sectional views of an alternate embodiment of the steps in the present invention.

Figure 12A:
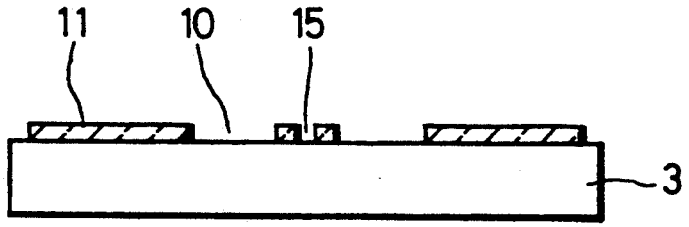
FIGS. 12(A), 12(B), 12(C), 12(D) are sectional views of an alternate embodiment of the steps in the present invention.
Figure 12B:
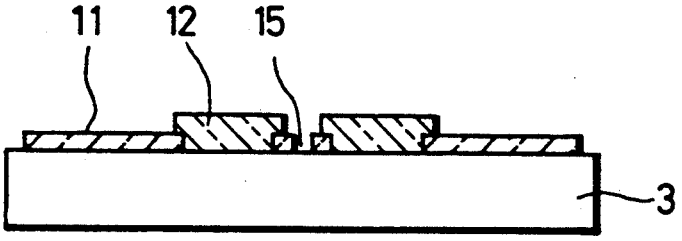
Figure 12C:
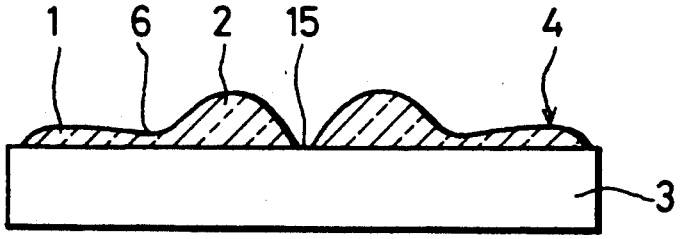
Figure 12D:
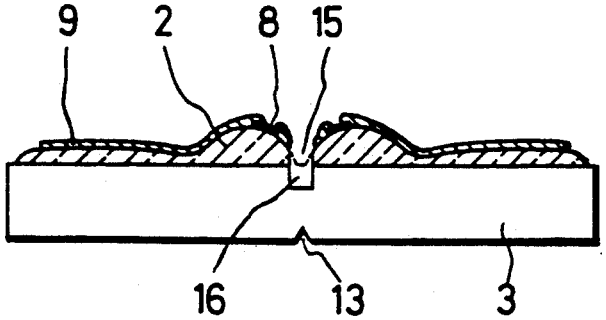

The first glass paste 11 is formed by the screen printing method in a pattern having a plurality of adjacent slit-shaped openings 10 and slit-shaped spacings 15 placed between the adjacent openings 10 in parallel over the principal surface of the substrate 3, as shown in FIG. 12(A). Next, the second glass paste 12 is formed by the screen printing method in a pattern having such independent bands as to cover the openings 10, as shown in FIG. 12(B). After this printing steps, the first and second glass pastes 11, 12 are melted and hardened by heat treatment at a temperature higher than the softening temperature of the second glass paste 12 so that the glazed substrate 4 having the ridge-shaped glaze layer is obtained, as shown in FIG. 12(C). Further, a plurality of isolated individual resistors 8 are formed by patterning after electrically resistive material is deposited in the vicinity of the crests of the second glaze layers 2. Furthermore, a plurality of isolated individual traces 9 are formed by patterning after electrically conductive material is deposited on the glazed substrate 4. Each of traces 9 connects at one end to each of the resistors 8 and applies electrical power for generating heat to the resistors 8. Lastly, the substrate 3 is divided into edge-shaped thermal heads by the snap lines 13 formed in the back of the substrate 3 and/or second snap lines 16 formed in the spacings 15, as shown in FIG. 12(D). In the presence of the spacings 15, when the first and second glass pastes 11, 12 are melted and hardened by heat treatment, it protects the adjacent second glaze layers 2 from merging. A minimum width of 0.2 mm for the spacing 15 is required for consistently separating the adjacent second glaze layers 2.

According to the present invention as described above, it is possible to have the stabilized shapes of the ridge-shaped glaze layers when they are formed adjacent to and in parallel with each other over the principal surface of the structure. Since the desired portions of the principal surface of the substrate can be coated with the first glaze layers, the substrate can have a smooth, if it is made of ceramics, to raise the patterning yield and can function as an insulating coating if it is made of a metal. Further, the principal surface of the substrate can be made smooth and continuous to facilitate sliding of heat sensitive paper.

What is claimed is:

1. A process for producing a plurality of thermal heads having a ridge-shaped glaze structure from a substrate, the process comprising the steps of:

A. printing a first glass paste having a softening temperature over a substrate in a pattern having at least one paired set of adjacent slit-shaped openings in parallel, B. printing a second glass paste having a softening temperature higher than the softening temperature of the first glass paste in a pattern of independent bands, each band covering a respective one of the slit-shaped openings, C. treating the first glass paste and the second glass paste by heating simultaneously to form a ridge-shaped glaze structure comprising a plane first glaze layer and at least one paired set of ridge-shaped second glaze layers on the substrate such that the thickness of the treated glaze located between the individual ridge-shaped second glaze layers of each paired set is less than the thickness of the plane first glaze layer, D. forming resistors arrayed linearly across the crest of the second glaze layers and forming traces for applying electrical energy to the resistors, and E. dividing the substrate into a plurality of thermal heads.

2. A process according to claim 1; wherein the pattern of the first glass paste includes slit-shaped spacings placed between the adjacent openings for preventing the independent bands of the second glass paste from merging during the heat treatment.

3. A process for producing a plurality of thermal heads according to claim 1, wherein the step of dividing the substrate into a plurality of thermal heads comprises forming a snap line in the substrate at a location beneath a region defined between the two adjacent ridge-shaped second glaze layers of each paired set, and separating the substrate along each snap line.

4. A process for producing a plurality of thermal heads according to claim 2, wherein the step of dividing the substrate into a plurality of thermal heads comprises forming snap lines in the region of the substrate adjacent the slit-shaped spacings, and separating the substrate along each snap line.

5. A process for simultaneously producing at least two thermal heads comprising the steps of:

forming a first glass paste layer having a softening temperature on a substrate in a pattern having at least one paired set of adjacent, parallel slit-shaped openings;

forming a second glass paste layer having a softening temperature higher than the softening temperature of the first glass paste on the substrate in a pattern of independent bands, each band covering a corresponding slit-shaped opening;

heating the first glass paste layer and the second glass paste layer to a temperature greater than the softening temperature of the second glass paste to thereby form a ridge-shaped glaze structure comprised of at least one pair of adjacent ridges such that the thickness of the glaze in the region between each pair of adjacent ridges is less than the thickness of the glaze located at other portions of the substrate; and forming resistors on the crests of the ridges such that only the second glass paste layer is directly between the resistors and the substrate to thereby form a plurality of thermal heads each comprised of one ridge with resistors formed thereon.

6. A process for simultaneously producing at least two thermal heads according to claim 5; wherein the steps of forming the first and second glass paste layers comprise screen printing.

7. A process for simultaneously producing at least two thermal heads according to claim 5; wherein the pattern of the first glass paste layer includes a slit-shaped spacing between each pair of adjacent slit-shaped openings for preventing the independent bands of the second glass layer form merging during heating.

8. A process for simultaneously producing at least two thermal heads according to claim 5; further comprising the steps of dividing the substrate into a plurality of thermal heads.

9. A method of forming a plurality of thermal heads, comprising the steps:

providing a substrate;

providing a first glass paste over the substrate in a pattern having at least one paired set of adjacent, parallel slit-shaped openings;

providing a second glass paste in a pattern of bands, each band covering a respective one of the slit-shaped openings;

heating the first glass paste and the second glass paste to form on the substrate a structure comprised of a plane glaze layer and at least one paired set of ridge-shaped glaze layers;

forming a U-shaped valley between the two ridge-shaped glaze layers of each paired set;

forming resistors along the crest of the ridge-shaped glaze layers; and dividing the substrate into a plurality of thermal heads.

10. A method of forming a plurality of thermal heads according to claim 9; wherein the step of forming a U-shaped valley is accomplished during the heating step.

11. A method of forming a plurality of thermal heads according to claim 9; wherein the pattern of the first glass paste includes a slit-shaped spacing between each pair of adjacent slit-shaped openings for preventing the bands of the second glass paste from merging during the heating step.

12. A method of forming a plurality of thermal heads according to claim 11; wherein the step of dividing the substrate into a plurality of thermal heads comprises forming a snap line in the region of the substrate adjacent each slit-shaped spacing, and separating the substrate along each snap line.

13. A method of forming a plurality of thermal heads according to claim 9; wherein the step of dividing the substrate into a plurality of thermal heads comprises forming a snap line in the substrate at a location beneath a region defined between the two adjacent ridge-shaped second glaze layers of each set, and separating the substrate along each snap line.

* * * * *